US005799785A

United States Patent [19]

Hsu

[11] Patent Number: 5,799,785

[45] Date of Patent: Sep. 1, 1998

[54] GOLF CLUB CONTAINING CYLINDER STRUCTURE

[76] Inventor: Kang-Chiang Hsu, No. 9, Lane Tsao-Ya-Nan-4, Mingli Li, Chien-Chen District, Kaohsiung, Taiwan

[21] Appl. No.: 783,808

[22] Filed: Jan. 16, 1997

[30] Foreign Application Priority Data

Dec. 27, 1996 [CN] China ..... 96 2 23170.3

[51] Int. Cl.[6] ..... A63B 55/00

[52] U.S. Cl. ..... 206/315.6; 206/315.2; 206/315.3

[58] Field of Search ..... 206/315.2–315.8

[56] References Cited

U.S. PATENT DOCUMENTS

| | | | |
|---|---|---|---|
| 1,563,816 | 12/1925 | Worthington | 206/315.2 |
| 2,436,687 | 2/1948 | Corbett | 206/315.6 |
| 2,722,258 | 11/1955 | Smidt et al. | 206/315.6 |
| 4,311,178 | 1/1982 | Kennedy | 206/315.6 |
| 4,691,823 | 9/1987 | Pape | 206/315.6 |
| 4,703,851 | 11/1987 | Stewert | 206/315.6 |
| 5,099,990 | 3/1992 | Antonious | 206/315.6 |
| 5,255,781 | 10/1993 | Dulyea, Sr. | 206/315.6 |
| 5,505,300 | 4/1996 | Joh | 206/315.6 |
| 5,511,660 | 4/1996 | Yamada et al. | 206/315.6 |
| 5,613,603 | 3/1997 | Joh | 206/315.6 |

FOREIGN PATENT DOCUMENTS

| | | | |
|---|---|---|---|
| 414168 | 8/1934 | United Kingdom | 206/315.5 |
| 2130102 | 5/1984 | United Kingdom | 206/315.6 |
| 9118650 | 12/1991 | WIPO | 206/315.3 |

*Primary Examiner*—Sue A. Weaver

*Attorney, Agent, or Firm*—Pro-Techtor International Services

[57] ABSTRACT

A golf club containing cylinder structure including a partitioning rack placed in a club containing cylinder is installed in a golf bag. The partitioning rack includes multiple elongated partitioning strips with different lengths and multiple connecting members interconnecting the partitioning strips to partition the club containing cylinder into multiple compartments. A club holding member and a club head retaining clip are located in each compartment for securely holding and retaining the clubs without collision, whereby the clubs can be separately smoothly placed in and taken out.

3 Claims, 3 Drawing Sheets

GOLF CLUB CONTAINING CYLINDER STRUCTURE

BACKGROUND OF THE INVENTION

The present invention relates to a golf club containing cylinder structure installed in a golf bag to partition the golf bag into multiple compartments for respectively receiving and retaining different clubs.

Generally, the golf clubs are randomly placed in a golf bag without any order. As a result, the clubs are apt to tangle with each other so that a player can hardly smoothly place in or take out the clubs. Moreover, during moving the golf bag, the heads of the clubs tend to collide each other. This often leads to damage of the clubs. Therefore, it is necessary to provide a device installed in the golf bag for stably retaining the respective clubs in order.

SUMMARY OF THE INVENTION

It is a primary object of the present invention to provide a golf club containing cylinder structure installed in a golf bag to partition the golf bag into multiple compartments for respectively receiving and retaining different clubs in order.

The present invention can be best understood through the following description and accompanying drawings, wherein:

DETAILED DESCRIPTION OF THE PREFERRED EMBODIMENT

Figure 1:
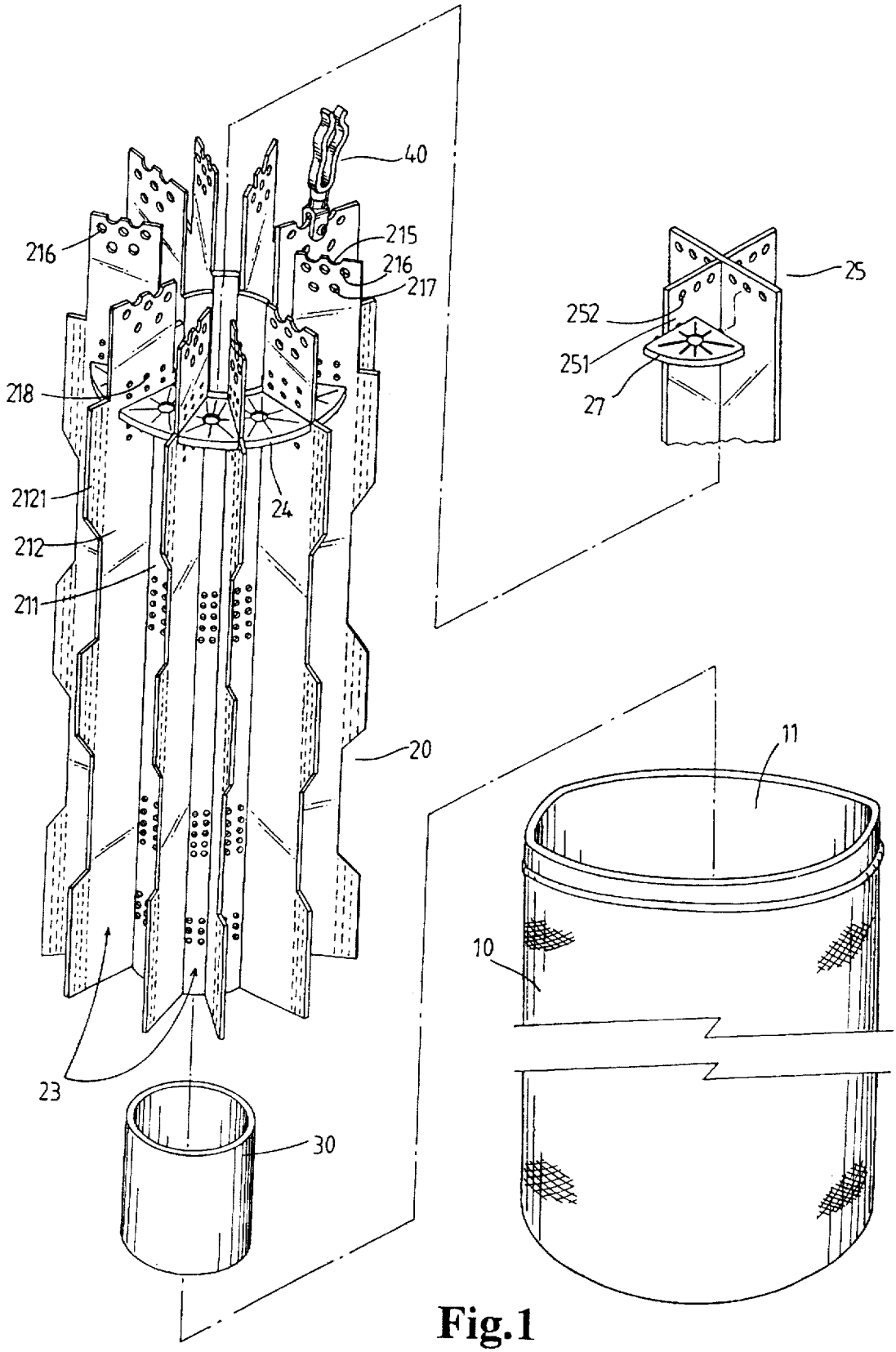
FIG. 1 is a perspective exploded view of the present invention.
Figure 5B:
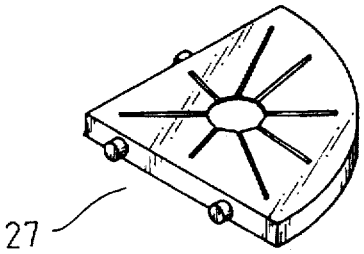
FIG. 5 is a perspective view of the sector-shaped club holding board of the present invention.
Figure 5A:
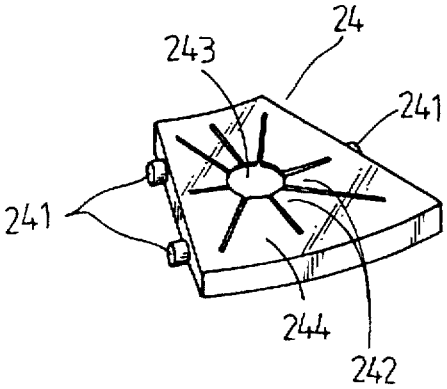

Please refer to FIGS. 1 to 5. The present invention includes a partitioning rack 20 placed in a club containing cylinder 11 disposed in a golf bag 10. The partitioning rack 20 includes multiple elongated partitioning strips 21 with different lengths and multiple connecting members 22 interconnecting the partitioning strips 21 to form the partitioning rack 20. Each partitioning strip 21 includes an arch strip 211 with a short arch cross-section and a straight strip 212 lengthwisely adjoined with the arch strip 211 to contain an angle. The arch strip 211 is formed with several groups of latch holes 213 at several sections thereof. A locating hole 214 is formed between each two adjacent latch holes 213. The outer edge of the straight strip 212 is formed with several cuttable projections 2121.

The top edge of the straight strip is formed with at least one notch 215. Several fixing holes 216 are formed below the top edge and several latch holes 217 are formed below the fixing holes 216. In addition, several rows of locating holes 218 are formed below the latch holes 217 corresponding to the locating holes 214 of the arch strip 211.

Each connecting member 22 has an arch attaching face 221 formed with at least two latch protrusions 222 corresponding to the latch holes 213 of the arch strip 211. The latch protrusions can be pressed into the latch holes 213 of two adjacent arch strips 211 so as to assemble the arch strips 211 into a cylinder with the straight strips 212 radially extending outward to partition the club containing cylinder 11 into multiple compartments 23.

A club holding member 24 is disposed with locating protrusions 241 corresponding to the locating holes 214, 218 in each compartment 23. The locating protrusions 241 can be pressed into the locating holes 214, 218 to secure the club holding member 24 in the compartment 23. Each club holding member 24 is formed with a central resilient plate 242 having a holding hole 243 with a diameter corresponding to the diameter of the club. The resilient plate 242 is also formed with several fissures radially extending outward from the holding hole 243 to divide the resilient plate into several resilient leaves 244. In addition, a cross-like partitioning rack 25 is disposed in the cylinder formed by the arch strips 211 so as to partition the cylinder into several compartments. Each vane 251 of the partitioning rack 25 is formed with locating holes 252 for securing another type of club holding member 27 in the compartment. The club holding member 27 has a structure similar to that of the club holding member 24 and will not be further discussed hereinbelow.

An elongated cylinder 30 is fitted into the bottom of the cylinder formed by the arch strips 211 by a depth determined by the position of the connecting members 22 locked with the bottom. Therefore, the fitting depth of the elongated cylinder 30 is varied with the locking position of the connecting members 22 and the height of the entire partitioning rack 20 can be adjusted by the fitting depth of the elongated cylinder 30 so as to meet the height of different golf bag.

A club head retaining clip 40 is disposed in the fixing hole 216 of the top edge of the straight strip 212. The club head retaining clip 40 is composed of an upper clip member 41 and a lower locking member 42. The clip member 41 has a resilient chuck 411 for clamping the club head 50 and a toothed bottom end 412. The locking member 42 has a locking frame 421 locked in the fixing holes 215 and a toothed top end 422 engaged with the toothed bottom end 412 of the chuck 411. A resilient fastening member 43 is passed through the top end of the locking member 42 and tightened at the bottom end of the clip member 41, whereby the clip member 41 can be resiliently pulled upward to disengage the toothed bottom end 412 and toothed top end 422 from each other.

At this time, the clip member 41 can be adjusted and rotated through 360 degrees relative to the locking member 42 so as to meet the inclination of different club head 50.

According to the above arrangement, the clubs can be respectively placed in different compartments and separated from each other by the partitioning rack without collision or abrasion. Moreover, the club holding members 24, 27 serve to stably hold the clubs and the club head retaining clips 40 serve to securely retain and clamp the club heads without loosening or rotation. Accordingly, the clubs can be separately smoothly placed in or taken out in order and stably held in the golf bag.

The elongated partitioning strips 21 have varied lengths in accordance with the lengths of different clubs, whereby the partitioning rack 20 is divided by the respective partitioning strips 21 into compartments with different heights so as to snugly receive different lengths of clubs.

Figure 2:
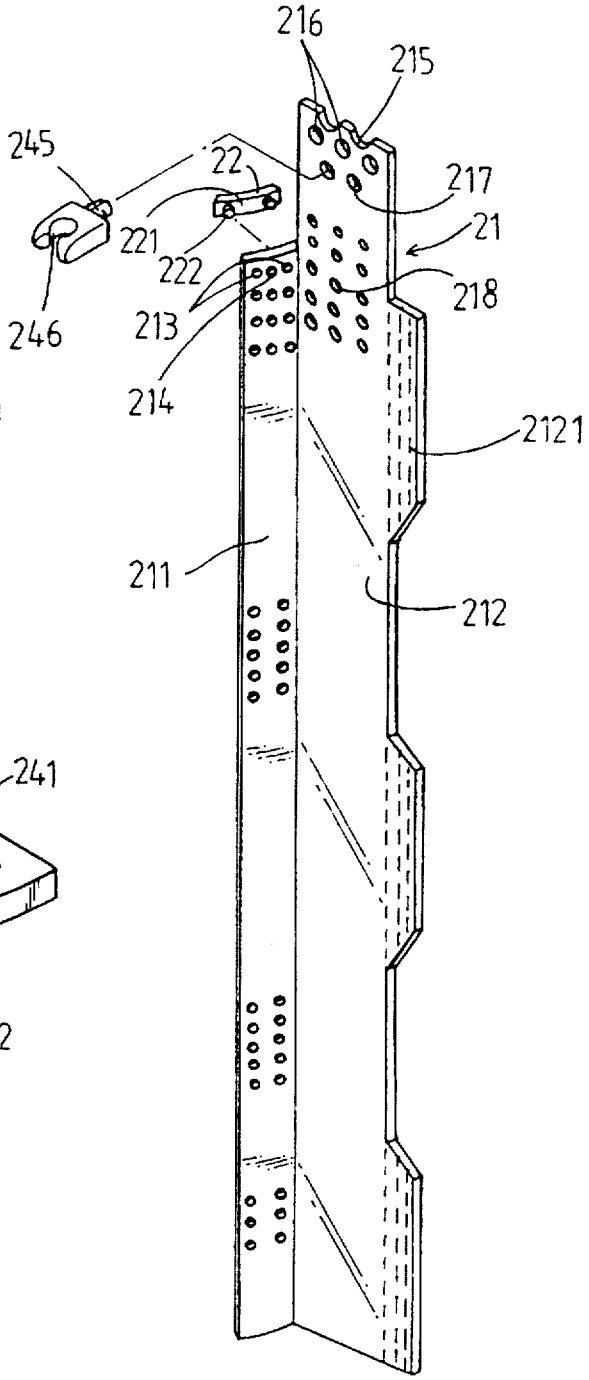
FIG. 2 is a perspective view of the elongated partitioning strip of the present invention.
Figure 3:
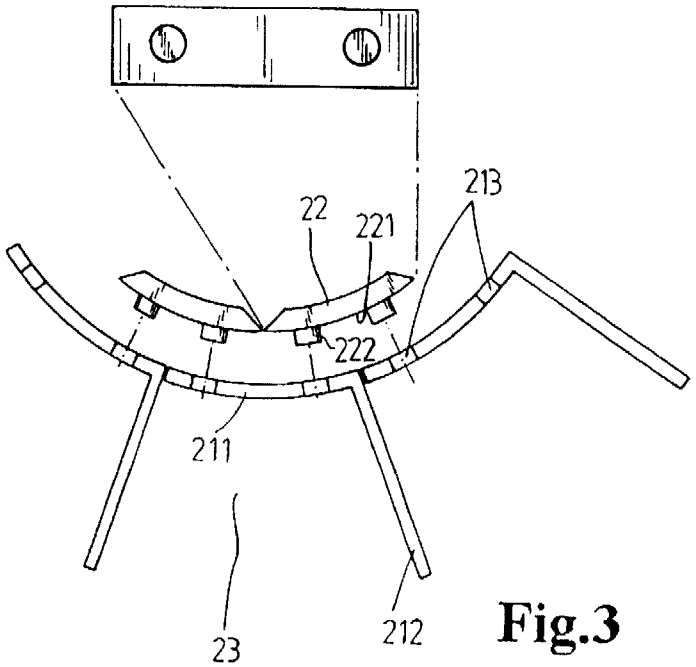
FIG. 3 shows that the adjacent partitioning strips are interconnected by the connecting plate of the present invention.
Figure 4:
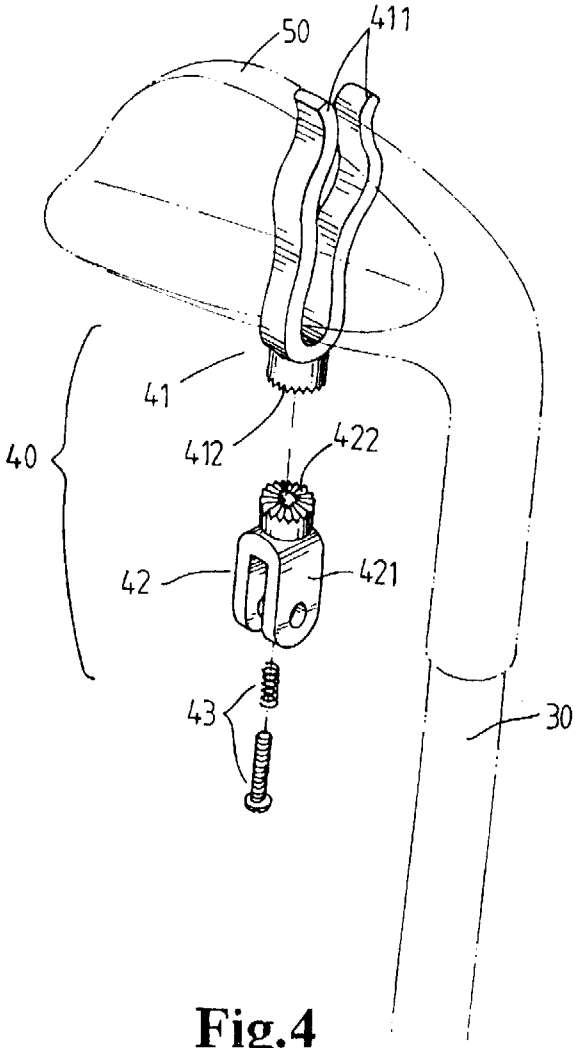
FIG. 4 is a perspective exploded view of the club head retaining clip of the present invention.

Referring to FIG. 2, alternatively, the club holding member 24 can be formed by a chuck block disposed with a locating protrusion 245 and an insertion notch 246. The locating protrusion 245 can be locked in the locating hole 218 or the latch hole 217 near the top edge of the straight strip. The club can be inserted into the insertion notch 246 and securely held therein.

The number of the partitioning strips can be increased or decreased, depending on the variety and dimension of the golf bag. In the case that the diameter of the partitioning rack 20 is larger than that of the club containing cylinder 11, the cuttable projections 2121 of the partitioning strip can be cut off so as to snugly place the partitioning rack 20 into the club containing cylinder 11 to partition the same into annularly arranged compartments. Also, when it is necessary to divide the same club containing cylinder into more compartments, the outer edge of the arch strip can be partially cut off to reduce the width of the arch strip, whereby more partitioning strips are needed to define the compartments so that the number thereof is increased for more clubs to insert therein.

It should be noted that the above description and accompanying drawings are only used to illustrate some embodiments of the present invention, not intended to limit the scope thereof. Any modification of the embodiments should fall within the scope of the present invention.

What is claimed is:

1. A golf club containing cylinder structure comprising:

a partitioning rack adapted to be placed in a club containing cylinder installed in a golf bag, said partitioning rack comprises multiple elongated partitioning strips with different lengths, and multiple connecting members interconnecting said partitioning strips to form said partitioning rack, each said partitioning strip includes an arch strip with a short arch cross section and a straight strip adjoined to said arch strip at an angle, said arch strip includes a plurality of groups of latch holes, each said connecting member includes an arch attaching face that includes at least two latch protrusions, a first one of said latch protrusions is received in a latch hole of a first arch strip, and a second one of said latch protrusions is received in a latch hole of a second arch strip, said second arch strip is adjacent to said first arch strip so that said arch strips are held in position with said straight strips extending outward such that said straight strips partition said club containing cylinder into multiple compartments; and said arch strips further include a locating hole between each two adjacent latch holes therein, and a plurality of rows of locating holes are formed on said straight strips corresponding to said locating holes of said arch strips, said locating holes receive a club holding member, said club holding member is shaped in conformance to a cross section of said compartments and include locating protrusions corresponding to said locating holes, said club holding member includes a central resilient plate with a holding hole therein, said resilient plate further includes a plurality of openings extending outward from said holding hole to divide said resilient plate into a plurality of leaves.

2. A golf club containing cylinder structure comprising:

a partitioning rack adapted to be placed in a club containing cylinder installed in a golf bag, said partitioning rack comprises multiple elongated partitioning strips with different lengths, and multiple connecting members interconnecting said partitioning strips to form said partitioning rack, each said partitioning strip includes an arch strip with a short arch cross section and a straight strip adjoined to said arch strip at an angle, said arch strip includes a plurality of groups of latch holes, each said connecting member includes an arch attaching face that includes at least two latch protrusions, a first one of said latch protrusions is received in a latch hole of a first arch strip, and a second one of said latch protrusions is received in a latch hole of a second arch strip, said second arch strip is adjacent to said first arch strip so that said arch strips are held in position with said straight strips extending outward such that said straight strips partition said club containing cylinder into multiple compartments; and wherein an elongated cylinder is received in a bottom of a cylinder formed by said arch strips, said elongated cylinder extends to into said cylinder formed by said arch strips to a depth defined by a position of said connecting members.

3. A golf club containing cylinder structure comprising:

a partitioning rack adapted to be placed in a club containing cylinder installed in a golf bag, said partitioning rack comprises multiple elongated partitioning strips with different lengths, and multiple connecting members interconnecting said partitioning strips to form said partitioning rack, each said partitioning strip includes an arch strip with a short arch cross section and a straight strip adjoined to said arch strip at an angle, said arch strip includes a plurality of groups of latch holes, and an outer edge of said straight strip includes cuttable projections, each said connecting member includes an arch attaching face that includes at least two latch protrusions, a first one of said latch protrusions is received in a latch hole of a first arch strip, and a second one of said latch protrusions is received in a latch hole of a second arch strip, said second arch strip is adjacent to said first arch strip so that said arch strips are held in position with said straight strips extending outward such that said straight strips partition said club containing cylinder into multiple compartments.

* * * * *